US007044090B2

(12) United States Patent
Ohtsu et al.

(10) Patent No.: US 7,044,090 B2
(45) Date of Patent: May 16, 2006

(54) COMBUSTION TYPE POWER TOOL FACILITATING CLEANING TO INTERNAL CLEANING TARGET

(75) Inventors: Shinki Ohtsu, Hitachinaka (JP); Yasuki Ohmori, Hitachinaka (JP)

(73) Assignee: Hitachi Koki Co., Ltd., Tokyo (JP)

( * ) Notice: Subject to any disclaimer, the term of this patent is extended or adjusted under 35 U.S.C. 154(b) by 0 days.

(21) Appl. No.: 10/915,427

(22) Filed: Aug. 11, 2004

(65) Prior Publication Data

US 2005/0035171 A1 Feb. 17, 2005

(30) Foreign Application Priority Data

Aug. 11, 2003 (JP) ..... P2003-291704

(51) Int. Cl.
*B27F 7/17* (2006.01)
*B21J 15/28* (2006.01)

(52) U.S. Cl. ..... 123/46 SC; 227/8

(58) Field of Classification Search ..... 123/46 R, 123/46 SC, 46 A, 46 B; 227/8, 9, 10, 130
See application file for complete search history.

(56) References Cited

U.S. PATENT DOCUMENTS 4,403,722 A 9/1983 Nikolich
4,483,280 A 11/1984 Nikolich
4,483,473 A 11/1984 Wagdy
4,483,474 A 11/1984 Nikolich
4,522,162 A 6/1985 Nikolich
RE32,452 E 7/1987 Nikolich
5,909,836 A * 6/1999 Shkolnikov et al. ..... 227/8

FOREIGN PATENT DOCUMENTS

EP 0 775 553 5/1997
EP 0 913 234 5/1999

* cited by examiner

*Primary Examiner*—Henry C. Yuen
*Assistant Examiner*—Hyder Ali
(74) *Attorney, Agent, or Firm*—Antonelli, Terry, Stout and Kraus, LLP.

(57) ABSTRACT

A combustion type power tool capable of performing cleaning to a cleaning target from outside of the tool without disassembly of a head cover and a head cap. In the head cap, first and second cleaning passages are formed. The first cleaning passage has one end open to an atmosphere and a closed inner end. The second cleaning passage has one end in communication with the first cleaning passage and another end open to a spark generating portion which is one of the cleaning target in the combustion type power tool. A check valve is disposed in the first cleaning passage for normally closing the one end of the first cleaning passage by a biasing force of a compression coil spring.

14 Claims, 7 Drawing Sheets

COMBUSTION TYPE POWER TOOL FACILITATING CLEANING TO INTERNAL CLEANING TARGET

BACKGROUND OF THE INVENTION

The present invention relates to a combustion-type power tool, and more particularly, to a combustion-type fastener driving tool in which a combustible liquidized gas is ejected from a gas canister into a combustion chamber, mixed with air and ignited to drive a piston, thus generating power to drive fasteners such as nails or the like. The combustion type power tool is particularly used in the field of architecture and civil engineering.

A conventional combustion-type driving tool generally includes a housing, a handle, a trigger switch, a head cap, a head cover, a combustion chamber frame, a push lever, a cylinder, a piston, a driver blade, a motor, a fan, a gas canister, an ignition plug, an exhaust-gas check valve, a magazine, and a tail cover. The head cap closes one end of the housing through screws. The handle is fixed to the housing and is provided with the trigger switch. The combustion chamber frame is movable in the housing in the lengthwise direction thereof. The combustion chamber frame is urged in a direction away from the head cap by a spring, and one end of the combustion chamber frame is abuttble on the head cap against the biasing force of the spring. The head cover is attached to an upper side of the head cap through. screws for supporting the motor in cooperation with the head cap and for protecting an upper end of the tool.

The push lever is movably provided at the other end of the housing and is coupled to the combustion chamber frame. The cylinder is secured to the housing and in communication with the combustion chamber frame. The cylinder guides the movement of the combustion chamber frame and is formed with an exhaust port. The piston is reciprocally movable in the cylinder and divides an interior of the cylinder into a lower cylinder chamber below the piston and an upper cylinder chamber above the piston. While the combustion chamber frame has its one end abutting on the head cap, a combustion chamber is defined in cooperation with the head cap, the combustion chamber frame and the upper cylinder chamber.

The driver blade extends from the end of the piston which faces away from the combustion chamber toward the other end of the housing. The motor is supported on the head cap. The fan is fastened to the motor and provided in the combustion chamber. The rotation of the fan by the motor mixes the combustible gas with air in the combustion chamber for promoting combustion. The fan also serves to introduce an external air into the housing when the combustion chamber frame is moved away from the head cap for scavenging within the combustion chamber frame, and at the same time serves to cool an outer peripheral side of the cylinder. The gas canister is assembleable in the housing and contains liquidized combustible gas such as propane and butane and a lubrication oil. The combustible gas is ejected into the combustion chamber through a gas passage formed in the head cap. The ignition plug is exposed to the combustion chamber for igniting a mixture of the combustible gas and air. The ignition plug includes a spark generating portion including a base electrode and an opposing electrode spaced away from the base electrode. The exhaust check valve is adapted for selectively closing the exhaust hole.

The magazine is positioned at the other end of the housing and contains fastening elements such as nails. The tail cover is interposed between the magazine and the push lever to supply the fastener from the magazine to a position of a moving locus of the driver bit. A guide clearance is formed at a lower end portion of the cylinder and the housing and at a portion where the driver blade passes for communicating the lower cylinder chamber with the atmosphere.

In order to provide a hermetic state of the combustion chamber when the combustion chamber frame is brought into abutment with the head cap, a first sealing member is provided at a predetermined position of the head cap for intimate contact with an upper portion of the combustion chamber frame and a second sealing member is provided at the outer peripheral surface of the cylinder near the head cap for intimate contact with a lower portion of the combustion chamber frame.

When the push lever is pushed against a workpiece, combustible gas is ejected into the combustion chamber from the gas canister assembled in the housing. In the combustion chamber, the combustible gas and air are stirred and mixed together by the fan. With this state, if the trigger switch is rendered ON, the ignition plug ignites the resultant mixture gas. The mixture gas explodes to drive piston for driving the driver blade, which in turn drives nails into a workpiece such as a wood block. After explosion, the combustion chamber frame is maintained in its abutting position to the head cap for a predetermined period of time. During this abutting period, the exhaust gas check valve is closed after the combustion gas is exhausted to maintain closing state of the combustion chamber. Further, thermal vacuum is generated in the upper cylinder chamber due to pressure drop caused by decrease in temperature. On the other hand, since the lower cylinder chamber is in fluid communication with the atmosphere through the guide clearance, the pressure in the lower cylinder chamber is greater than that in the upper cylinder chamber, so that the piston restores its original top dead center position. Thereafter, when the trigger switch is released and the push lever is moved to separate from the workpiece (not shown), the push lever is moved downward because of the biasing force of the spring to communicate the combustion chamber with the atmosphere, thereby performing scavenging by the rotation of the fan and recovering original position. See for example, U.S. Pat. No. 4,403,722.

As described above, in the conventional combustion type power tool, sealing by the sealing members are released in accordance with the rotation of the fan and the downward movement of the combustion chamber frame, so that exhaust gas after combustion is discharged to the atmosphere for cooling the combustion chamber. Accordingly, great amount of atmospheric air passes through the combustion chamber. In this case, such power tool is used under dusty working environment such as outdoor and building site where cutting wood chips and minute dust such as fibrous dust and soil dust are floating in the air. Such foreign materials are sucked into the power tool to cause operational breakdown. More specifically, lubrication oil contained in the combustible gas is adhered to various components of the power tool, and minute dust in the air is in contact with the lubrication oil and absorbed therein. Thus, the dust is deposited on the various parts of the power tool. Particularly, ignition cannot properly occur if greater amount of dust is deposited at a space between the base electrode and the opposing electrode of the spark generating portion. Consequently, combustion does not occur.

Other disadvantageous phenomenon is also noted on the deposition of the dust involved in the lubrication oil onto the annular grooves and O-rings serving as the first and second sealing members. By this dust deposition, upward and downward movement of the combustion chamber frame cannot be smoothly performed, making opening and closing of the combustion chamber difficult.

Conventionally, when such disadvantageous phenomena occur, several screws are unfastened to remove the head cap and the head cover from the housing to directly access the inner surface of the head cap and the combustion chamber frame. Thus, the base electrode and the opposing electrode can be subjected to cleaning with a cleaning liquid to remove the dust and lubrication oil therefrom, or first and second sealing members and ring grooves can be cleaned. Cleaning cycle is influenced by using environment of the power tool. If power tool is frequently used at the dusty environment, the cleaning must be performed by a weekly basis. Even if the power tool is used at a less dusty environment, cleaning must be performed by monthly basis. As described above, cleaning requires, disassembly and assembly of the power tool, which prolong cleaning period. Further, parts and components such as screws may be missing and electrical wiring may be damaged as a result of disassembly.

SUMMARY OF THE INVENTION

It is therefore, an object of the present invention to provide a combustion type power tool capable performing cleaning to a target to be cleaned from an external side of the tool without disassembly of the head cover and the head cap.

To attain the above-described object, the present invention provides a combustion-type power tool including a housing, a head section, a push lever, a cylinder, a piston, a combustion chamber frame, a first sealing section, an ignition plug, and a shut-off unit. The head section closes one end of the housing and is formed with a combustible gas passage. The push lever is provided to the lower side of the housing and is movable upon pushing onto a workpiece. The cylinder is secured to an inside of the housing. The piston is slidably disposed in the cylinder and is reciprocally movable in an axial direction of the cylinder. The piston divides an interior of the cylinder into a lower cylinder chamber below the piston and an upper cylinder chamber above the piston. The combustion chamber frame is movably provided in the housing. The combustion chamber frame is abuttable on and separable from the head section in interlocking relation to the movement of the push lever. A combination of the head section, the upper cylinder chamber, and the combustion chamber frame defines a combustion chamber. The first sealing section provides a sealing relation between the combustion chamber frame and the head section when the combustion chamber frame is-brought into abutment with the head section. The ignition plug is supported to the head section and has a spark generating portion exposed to the combustion chamber for igniting a mixture of air and the combustible gas in the combustion chamber. At least one of the spark generating portion and the first sealing section is a target to be cleaned during non-operational state of the power tool. The head section is formed with a cleaning passage having one end open to an atmosphere and another end open to the target to be cleaned. The shut-off unit is provided in the cleaning passage for shutting-off the cleaning passage from the atmosphere during fastener driving operation. Preferably, a second sealing section provides a sealing relation between the combustion chamber frame and the cylinder when the combustion chamber frame is brought into abutment with the head section. The second sealing section is also a target to be cleaned.

With this arrangement, cleaning to the cleaning target can be performed externally of the tool through the cleaning passage without detachment of the head section from the housing. Therefore, a period requiring for the cleaning can be greatly reduced, and further, loss of mechanical component such as screws and damage to the electrical wiring due to the detachment can be eliminated.

Preferably, the shut-off unit includes a one-way valve disposed within the cleaning passage and urged in a direction to close the cleaning passage. With this arrangement, if a compression type cleaning liquid ejection canister is employed and a nozzle of the canister is inserted into one end of the cleaning passage and the cleaning liquid is injected, the one-way valve can be automatically opened because of the ejection pressure of the cleaning liquid, so that the cleaning liquid can be supplied to the cleaning target. If ejection of the cleaning liquid is stopped, the one-way valve automatically closes the cleaning passage. Thus, automatic opening and closing of the cleaning passage can be performed.

Preferably, the first sealing section includes a seal ring, and the head section is formed with an annular groove for assembling therein the seal ring. The cleaning passage is in fluid communication with a bottom surface of the annular groove. With this arrangement, if the cleaning liquid is supplied into the cleaning passage, the cleaning liquid can be flowed into the annular groove to easily clean the annular groove and the seal ring.

Alternatively, the cleaning passage has an inner peripheral surface formed with a female thread, and the shut-off unit includes a plug member having an outer peripheral surface formed with a male thread detachably and threadingly engageable with the female thread. With this arrangement, cleaning passage can be easily opened and closed by detachment and attachment of the plug member.

DETAILED DESCRIPTION OF THE PREFERRED EMBODIMENTS

Figure 1:
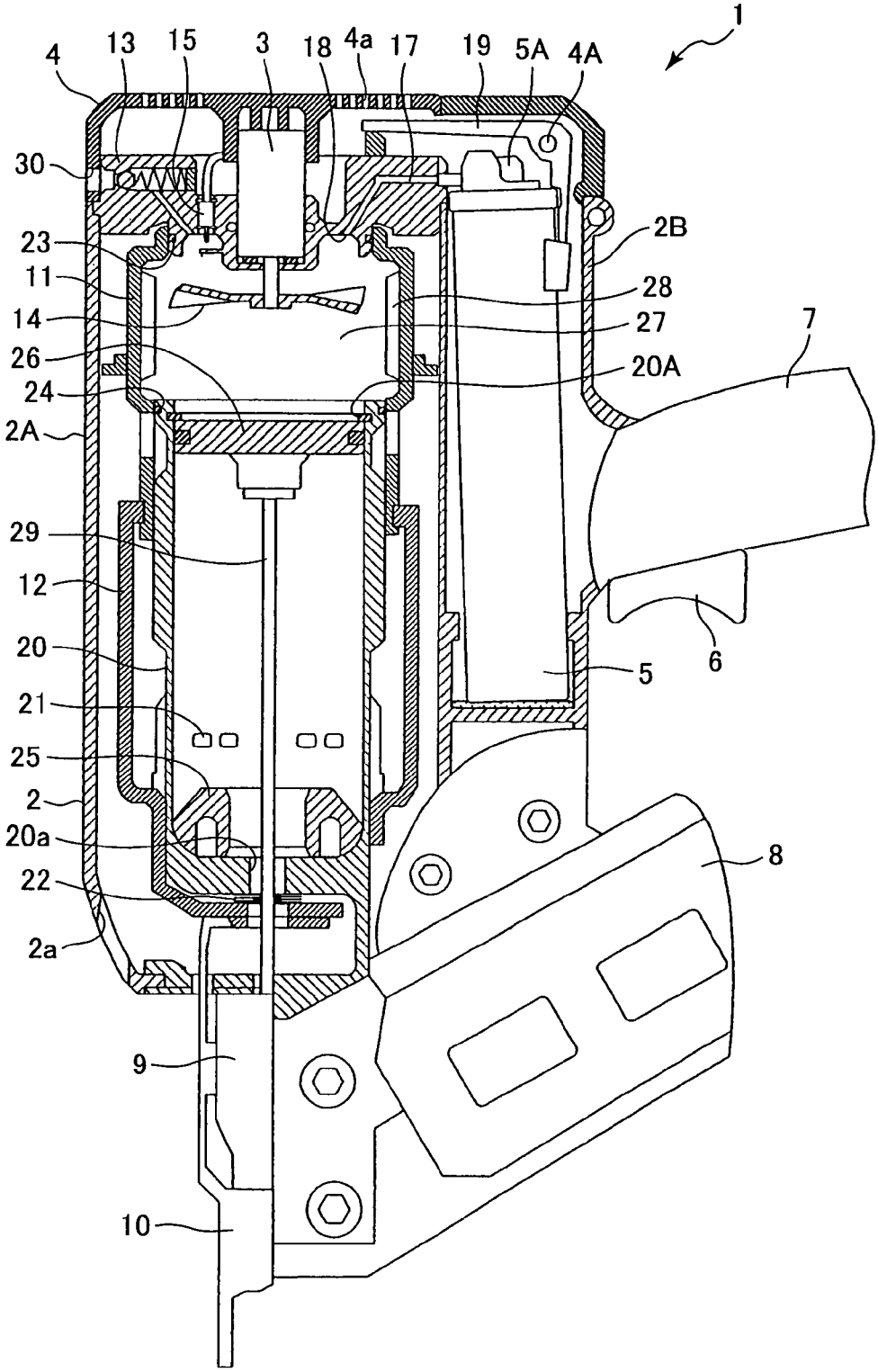
FIG. 1 is a vertical cross-sectional view showing a combustion type nail driving tool according to a first embodiment of a combustion type power tool of the present invention and showing a pushing state of the tool against a workpiece for fastener driving operation.
Figure 2:
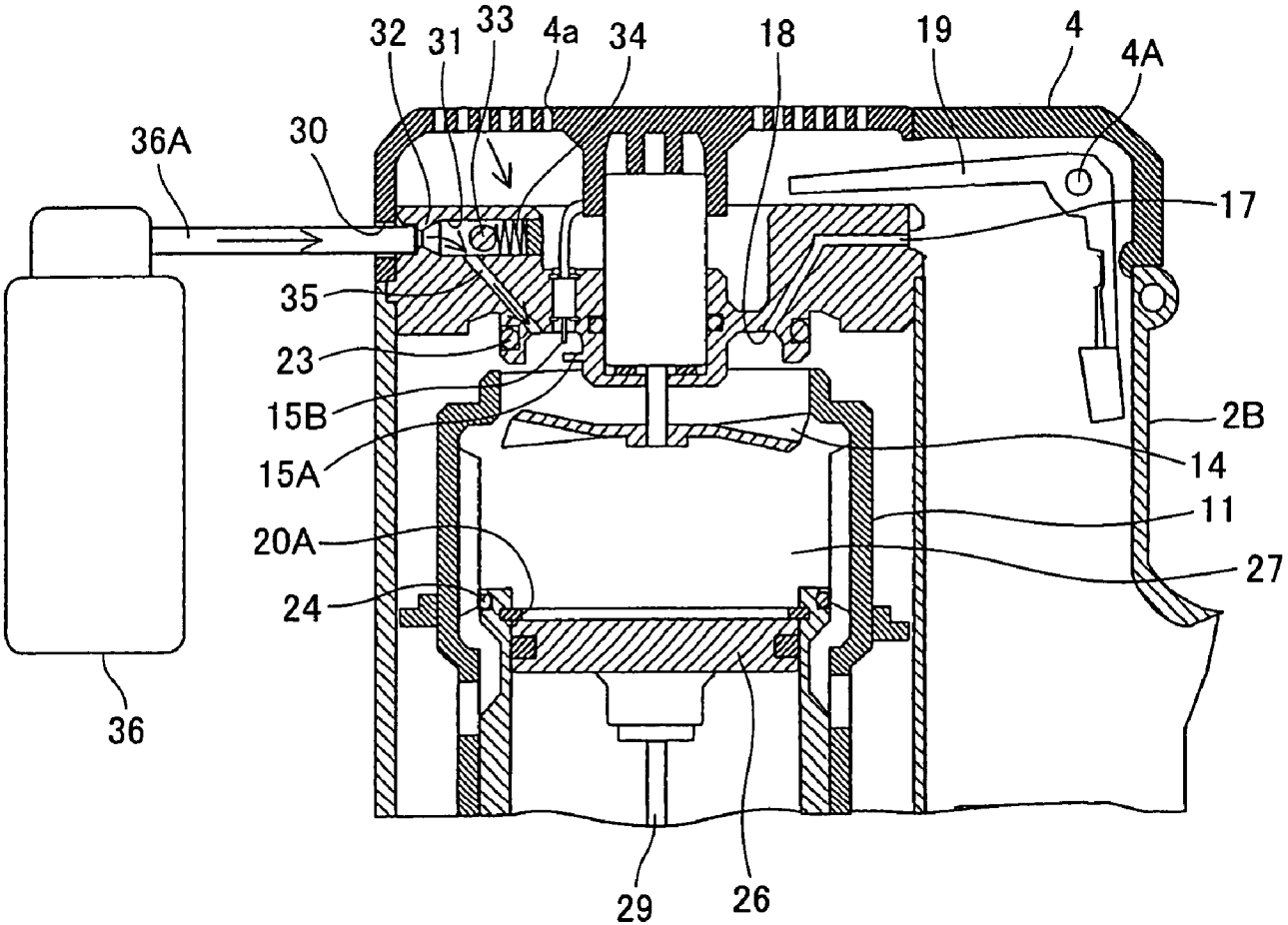
FIG. 2 is a partial cross-sectional view showing the combustion type nail driving tool according to the first embodiment, and showing a cleaning state.

A combustion-type power tool according to a first embodiment of the present invention will be described with reference to FIGS. 1 and 2. The embodiment pertains to a combustion type nail driver. The combustion type nail driver 1 has a housing 2 constituting an outer frame and including a main housing 2A and a canister housing 2B juxtaposed to the main housing 2A. An exhaust port 2*a* is formed at a lower portion of the main housing 2A.

A head cover 4 formed with suction ports 4*a* is mounted on the top of the main housing 2A, and a gas canister 5 containing therein a combustible gas is detachably disposed in the canister housing 2B. A handle 7 having a trigger switch 6 extends from the canister housing 2B. A magazine 8 and a tail cover 9 are provided on the bottoms of the main housing 2A and canister housing 2B. The magazine 8 contains nails (not shown), and the tail cover 9 is adapted to guidingly feed each nail in the magazine 8 and set the nail to a predetermined position.

A push lever 10 is movably provided at the lower end of the main housing 2A and is positioned in conformance with a nail setting position defined by the tail cover 9. The push lever 10 is coupled to a coupling member 12 that is secured to a combustion chamber frame 11 which will be described later. A compression coil spring 22 is interposed between a lower portion of the coupling member 12 and a bottom surface of a cylinder 20 described later for biasing the combustion chamber frame 11 in a direction opposite to the head cover 4. When the entire housing 2 is pressed toward a workpiece against the biasing force of the compression coil spring 22 while the push lever 10 is in abutment with the workpiece, an upper portion of the push lever 10 is retractable into the main housing 2A.

A head cap 13 is secured to the top of the main housing 2A and closes the open top end of the main housing 2A. The head cap 13 supports a motor 3 having a motor shaft, and a fan 14 is coaxially fixed to the motor shaft. The head cap 13 also supports a plug body and an opposing electrode 15B of an ignition plug 15 ignitable upon manipulation to the trigger switch 6. The ignition plug 15 also includes a base electrode 15A slightly spaced away from and in confrontation with the opposing electrode 15B. A combination of the base electrode 15A and the opposing electrode 15B constitutes a spark generating portion, and a target to be cleaned. Incidentally, the base electrode 15A is provided integrally with the head cap 13.

A head switch (not shown) is provided in the main housing 2A for detecting an uppermost stroke end position of the combustion chamber frame 11 when the power tool is pressed against the workpiece. The head switch can be turned ON when the push lever 10 is elevated to a predetermined position for starting rotation of the motor 3, thereby starting rotation of the fan 14.

The head cap 13 has a canister housing side in which is formed a fuel ejection passage 17 which allows a combustible gas to pass therethrough. One end of the ejection passage 17 serves as an ejection port 18 that opens at the lower surface of the head cap 13. Another end of the ejection passage 17 functions as a connecting portion connecting to a gas canister 5 detachably installed in the canister housing 2B. The gas canister 5 contains therein a liquidized combustible gas such as propane and butane and several % of lubrication oil. The gas canister 5 has an upper portion provided with a gauge 5A for allowing a constant amount of combustible gas to pass therethrough. Further, a pin 4A extends from the head cover 4, and a lever 19 is pivotally movably supported to the head cover 4 by the pin 4A for pressing the gas canister 5 toward the head cap 13 so as to eject gas. A ring groove is formed in the head cap 13, and a first seal member 23 such as an O-ring is installed in the ring groove for providing a seal between the head cap 13 and the combustion chamber frame 11 when the upper end of the combustion chamber frame 11 abuts on the head cap 13. The first seal member 23 and the ring grooves are one of the targets to be cleaned.

The combustion chamber frame 11 is provided in the main housing 2A and is movable in the lengthwise direction of the main housing 2A. The uppermost end of the combustion chamber frame 11 is abutable on the lower surface of the head cap 13. The coupling member 12 described above is secured to the lower end of the combustion chamber frame 11 and is connected to the push lever 10. Therefore, the combustion chamber frame 11 is movable in interlocking relation to the push lever 10. A cylinder 20 is fixed to the main housing 2A. The inner circumference of the combustion chamber frame 11 is in sliding contact with an outer peripheral surface of the cylinder for guiding movement of the combustion chamber frame 11. The cylinder 20 is formed with an exhaust hole 21 at an axially intermediate portion thereof and in communication with the exhaust port 2*a* of the main housing 2A. Further, an exhaust-gas check valve (not shown) is provided to selectively close the exhaust hole 21. Furthermore, a bumper 25 is disposed at a bottom portion of the cylinder 20. A-ring groove is formed at an upper outer peripheral surface of the cylinder 20. A second seal member 24 such as an O-ring is assembled in the ring groove to provide a seal between the inner circumference of the lower part of the combustion chamber frame 11 and the outer circumference of the upper part of the cylinder 20 when the combustion chamber frame 11 abuts on the head cap 13. The cylinder 20 has a bottom wall formed with a bottom hole 20*a* in communication with an atmosphere through the exhaust port 2*a*.

A piston 26 is slidably and reciprocally provided in the cylinder 20. The piston 26 divide an internal space of the cylinder into an upper cylinder chamber above the piston and a lower cylinder chamber below the piston. When the upper end of the combustion chamber frame 11 abuts on the head cap 13, the head cap 13, the combustion chamber frame 11, the upper cylinder chamber, and the first and second sealing members 23, 24 define in combustion a combustion chamber 27. When the combustion chamber frame 11 is separated from the head cap 13, a first flow passage in communication with the atmosphere is provided between the head cap 13 and the upper end of the combustion chamber frame 11, and a second flow passage in communication with the first flow passage is provided between the lower end portion of the combustion chamber frame 11 and the upper outer peripheral surface portion of the cylinder 20. The second flow passage allows a combustion gas and a fresh air to pass along the outer peripheral surface of the cylinder 20 for discharging these gas through the exhaust port 2*a* of the main housing 2A. A stop ring 20A is fixedly secured to an upper inner peripheral surface of the cylinder 20 for regulating upward movement of the piston 26.

A plurality of ribs 28 are provided on the inner peripheral portion of the combustion chamber frame 11 which portion defines the combustion chamber 27. The ribs 28 extend in the lengthwise direction of the combustion chamber frame 11 and project radially inwardly toward the axis of the main housing 2A. The ribs 28 cooperate with the fan 14 to promote the stirring and mixing of air with the combustible gas in the combustion chamber 27. The above-mentioned intake ports 4*a* are adapted to supply air into the combustion chamber 27, and the exhaust hole 21 and the exhaust port 2*a* are adapted to exhaust the combusted gas from the combustion chamber 27.

The fan 14, the ignition plug 15 and the ejection port 18 are respectively exposed and open to the combustion chamber 27. Rotation of the fan 14 performs the following three functions. First, the fan 14 stirs and mixes the air with the combustible gas as long as the combustion chamber frame 11 remains in abutment with the head cap 13. Second, after the mixed gas has been ignited, the fan 14 causes turbulence of the air-fuel mixture, thus promoting the combustion of the air-fuel mixture in the combustion chamber 27. Third, the fan 14 performs scavenging such that the exhaust gas in the combustion chamber 27 can be scavenged therefrom and also performs cooling to the combustion chamber frame 11 and the cylinder 20 when the combustion chamber frame 11 moves away from the head cap 13 and when the first and second flow passages are provided.

A driver blade 29 extends downwards from a side of the piston 26, the side being facing the lower cylinder chamber, to the lower end of the main housing 2A. The driver blade 29 is positioned coaxially with the nail setting position in the tail cover 9, so that the driver blade 29 can strike against the nail. When the piston 26 moves downward, the tip end of the driver blade 29 strikes the nail into the workpiece, and then the piston 26 abuts on the bumper 25 whereupon surplus energy is absorbed into the bumper 25 for stopping the piston 26.

Through-holes are formed at bottom walls of the coupling member 12 and the main housing 2A, so that the driver blade 29 can pass through the through-holes and the bottom hole 20*a* of the cylinder 20. Thus, the lower cylinder chamber is in communication with the atmosphere through the through-holes and the bottom hole 20*a* and through the exhaust port 2*a*. Because of this fluid communication, external air can be introduced into the lower cylinder chamber when the piston 26 restores its initial top dead center position.

As described above, the head cover 4 has a top portion formed with intake ports 4*a*, and a side portion formed with an insertion hole 30 that allows a nozzle 36A of a compression type cleaning liquid canister 36 to extend therein. A first cleaning passage 31 radially extends in the head cap 13. The first cleaning passage 31 has one end opened to the insertion hole 30. A valve seat 32 is provided near the one end of the first cleaning passage 31 in a tapered fashion. A spherical check-valve 33 is seatable on the valve seat 32. On the other hand, a radially inner end of the first cleaning passage 31 is closed, and a compression coil spring is interposed between the closed end and the check valve 33 for normally urging the check valve 33 to a direction to seat on the valve seat 32.

A second cleaning passage 35 is also formed in the head cap 13. The second cleaning passage is branched from an intermediate position of the first cleaning passage 31 and is directed to a clearance defined between the base electrode 15A and the opposing electrode 15B. In other words, an inner end of the second cleaning passage 35 is open to a position near the clearance. The check-valve 33 and the compression coil spring 34 allow a fluid to pass from the insertion hole 30 to the second cleaning passage 35 but prevent the fluid from flowing from the second cleaning passage 35 to the insertion hole 30. The compression coil spring 34 provides a sufficient spring force capable of seating the check valve 33 onto the valve seat 32 even when the combustion chamber frame 27 is at the thermal vacuum phase. More specifically, the spring force must be greater than a product of multiplying a thermal vacuum pressure of 0.05 Mpa by a seal area of the check valve 33. On the other hand, the spring force must be lesser than the injection pressure of the cleaning liquid ejected from the cleaning liquid canister 36 so that the check valve 33 can be moved away from the valve seat 32 by the injection pressure. For example, the spring force is 0.35 N in case the seating area of the check valve has a diameter of 3 mm.

Operation of the combustion type driving tool 1 according to the first embodiment will next be described. In the non-operational state of the combustion type nail driver 1, the push lever 10 is biased downward by the biasing force of the compression coil spring 22, so that the push lever 10 protrudes from the lower end of the tail cover 9. Thus, the uppermost end of the combustion chamber frame 11 is spaced away from the head cap 13 because the coupling member 12 couples the combustion chamber frame 11 to the push lever 10.

Further, a part of the combustion chamber frame 11 which part defines the combustion chamber 27 is also spaced from the top portion of the cylinder 20. Hence, the first and second flow passages are provided. In this condition, the piston 26 stays at the top dead center in the cylinder 20.

With this state, if the push lever 10 is pushed onto the workpiece such as a wood block while holding the handle 7 by a user, the push lever 10 is moved upward against the biasing force of the compression coil spring 22. At the same time, the combustion chamber frame 11 which is coupled to the push lever 10, is also moved upward, closing the above-described flow passages. Thus, the sealed combustion chamber 27 is provided by the sealing members 23 and 24.

When the push lever 10 is further pressed, the lever 19 is pivotally moved about the pin 4A by a cam (not shown), so that an entire gas canister 5 is tilted toward the head cap 13. Thus, an ejection rod of the gas canister 5 is pushed against the gas canister connecting portion of the head cap 13. Accordingly, a liquidized combustible gas in the gas canister 5 is injected once from the ejection hole 18 into the combustion chamber 27 through the gauge portion 5A.

Further, in accordance with the movement of the push lever 10, the combustion chamber frame 11 reaches the uppermost stroke end whereupon the head switch is turned ON to start rotation of the fan 14. Rotation of the fan 14 stirs and mixes the combustible gas with air in the combustion chamber 27 in cooperation with the ribs 28 protruding into the combustion chamber 27.

The ignition plug 15 generates a spark, which ignites the gas mixture upon turning ON the trigger switch 6 at the handle 7. At this time, the fan 14 keeps rotating, promoting the turbulent combustion of the gas mixture. This enhances the output of the power tool. The combusted and expanded gas pushes the piston 26 downward. Therefore, a nail in the tail cover 9 is driven into the workpiece through the driver blade 29 until the piston 26 abuts on the bumper 25.

Air in the lower cylinder chamber pushes the exhaust check valve (not shown) to open the exhaust hole 21 so that the air is discharged outside through the exhaust hole 21 and the bottom hole 20*a* of the cylinder 20 until the piston 26 reaches the exhaust hole 21 of the cylinder 20. As the piston 26 passes by the exhaust hole 21 of the cylinder 20, the exhaust check valve (not shown) is urged to open the exhaust hole 21 because of the application of the pressure of the combustion gas in the upper cylinder chamber. Therefore the combustion gas is discharged from the cylinder 20 through the exhaust hole 21 and then discharged outside through the exhaust port 2*a* of the main housing 2A.

The exhaust check valve (not shown) is closed when the pressure in the cylinder 20 and combustion chamber 27 is restored to the atmospheric pressure as a result of the discharge of the combustion gas out of the cylinder 20. Combustion gas still remaining in the cylinder 20 and the combustion chamber 27 has a high temperature at a phase immediately after the combustion. However, the high temperature is absorbed into the walls of the cylinder 20 and the combustion chamber frame 11 to rapidly cool the combustion gas. Thus, the pressure in the sealed space in the cylinder 20 above the piston 26 further drops to less than the atmospheric pressure (creating a so-called "thermal vacuum"). Accordingly, the piston 26 is moved back to the initial top dead center in the cylinder 20 by virtue of the internal pressure difference between in the lower cylinder chamber (atmospheric pressure) and in the upper cylinder chamber.

Then, the user turns off the trigger switch 6 and lifts the combustion type nail driver 1 from the workpiece for separating the push lever 10 from the workpiece. As a result, the push lever 10 and the combustion chamber frame 11 move downward due to the biasing force of the compression coil spring 22. Therefore, the first and second flow passages are provided again. Thus, fresh air flows into the combustion chamber 27 through the intake ports and through the flow passages, expelling the residual gas. Thus, the combustion chamber 27 is scavenged. Then, the combustion type nail driver 1 restores its initial state for the next nail driving operation. During the above-described operation, since the check-valve 33 is urged to its closing position by the biasing force of the compression coil spring 31, the first cleaning passage 31 is continuously shut-off from the atmosphere. Therefore, no communication occurs between the combustion chamber 27 and the atmosphere through the cleaning passage 31.

Cleaning to the space between the base electrode 15A and the opposing electrode 15B, those serving as the spark generating portion is required, since a mixture of lubrication oil contained in the combustible gas and dust involved in the atmosphere is deposited at the clearance due to repeated nail driving operation. For the cleaning, first, the gas canister 5 is detached while the combustion chamber frame 11 is at its descent position. Then, as shown in FIG. 2, the nozzle 36A of the compression type cleaning liquid canister 36 is inserted into the insertion hole 30 to inject compressed cleaning liquid. As a result, the check valve 33 is moved away from the valve seat 32 against the biasing force of the compression coil spring 34 by the injection pressure of the cleaning liquid. Thus, the cleaning liquid reaches the base electrode 15A and the opposing electrode 15B of the ignition plug 15 through the first and second cleaning passages 31,35 for cleaning these electrodes. If injection of the compressed cleaning liquid is stopped, the check valve 33 is seated onto the valve seat 32, so that the first cleaning passage 31 is shut off from the atmosphere.

As described above, in the combustion type fastener driving tool 1 according to the first embodiment of the present invention, the head cap 13 is formed with the cleaning passage whose one end is open to the atmosphere and another end is directed to the spark generating portion as the cleaning target. Further, the check valve 33 is disposed in the first cleaning passage 31 for shutting off the first cleaning passage from the atmosphere during fastener driving operation. Therefore, the spark generating portion can be cleaned from outside of the tool through the first and second cleaning passages 31,35 without any removal of the head cover 4 and the head cap 13 from the main housing 2A for exposing the combustion chamber 27 to the atmosphere. Consequently, labor for cleaning can be greatly reduced. Moreover, any loss of the parts and any damage to the electrical wiring can be avoided because of no necessity of disassembly.

Further, the check valve 33 is disposed in the first cleaning passage 31 and is biased in a direction to close the first cleaning passage by the compression coil spring 34 for serving as a one-way valve. If the nozzle 36A of the cleaning liquid canister 36 is inserted into one end of the first cleaning passage 31 and the compressed cleaning liquid is injected, the check valve 33 is automatically open the cleaning passage because of the injection pressure of the cleaning liquid to permit the cleaning liquid to be supplied into the cleaning target. If the injection is stopped, the check valve 33 is automatically closes the first cleaning passage 31. In this way, automatic opening and closing operation of the check-valve 33 can be performed.

A combustion type nail driving tool 101 according to a second embodiment will next be described with reference to FIGS. 3 and 4, wherein like parts and components are designated by the same reference numerals as those shown in FIGS. 1 and 2 to avoid duplicating description.

In the second embodiment, a head cover 104 is formed with intake ports 104*a* and an insertion hole 130, and a head cap 113 is formed with a linear cleaning passage 131 having one end in confrontation with the insertion hole 130 and another end open to a clearance defined between the base electrode 15A and the opposing electrode 15B of the ignition plug 15. Although not shown, the head cap 113 is also formed with a passage that allow air to pass from outside of the tool into the combustion chamber 27. The cleaning passage 131 has an inner diameter capable of observing the base electrode 15A and the opposing electrode 15B from outside of the main housing 2A and an inner peripheral surface of the cleaning passage 131 is formed with a female thread 131*a*. A plug member 133 is insertable into the cleaning passage 131. The plug member 133 has an outer peripheral surface formed with a male thread 133*a* threadingly engageable with the female thread 131*a*. Further, the plug member 133 has a top end formed with an engagement groove 133*b* with which a coin is engageable.

Figure 3:
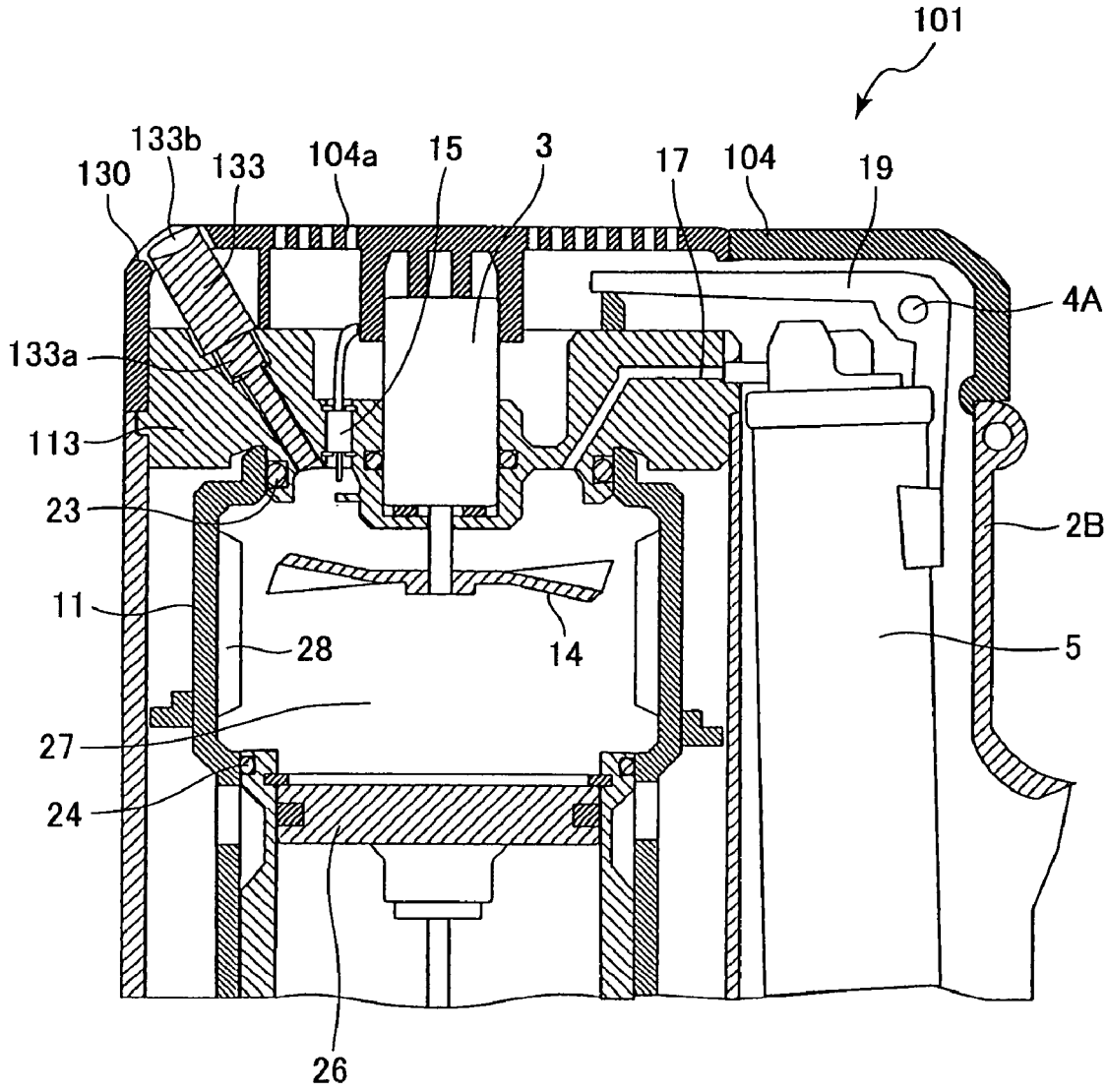
FIG. 3 is a partial cross-sectional view showing a combustion type nail driving tool according to a second embodiment of the present invention and showing a fastener driving state.
Figure 4:
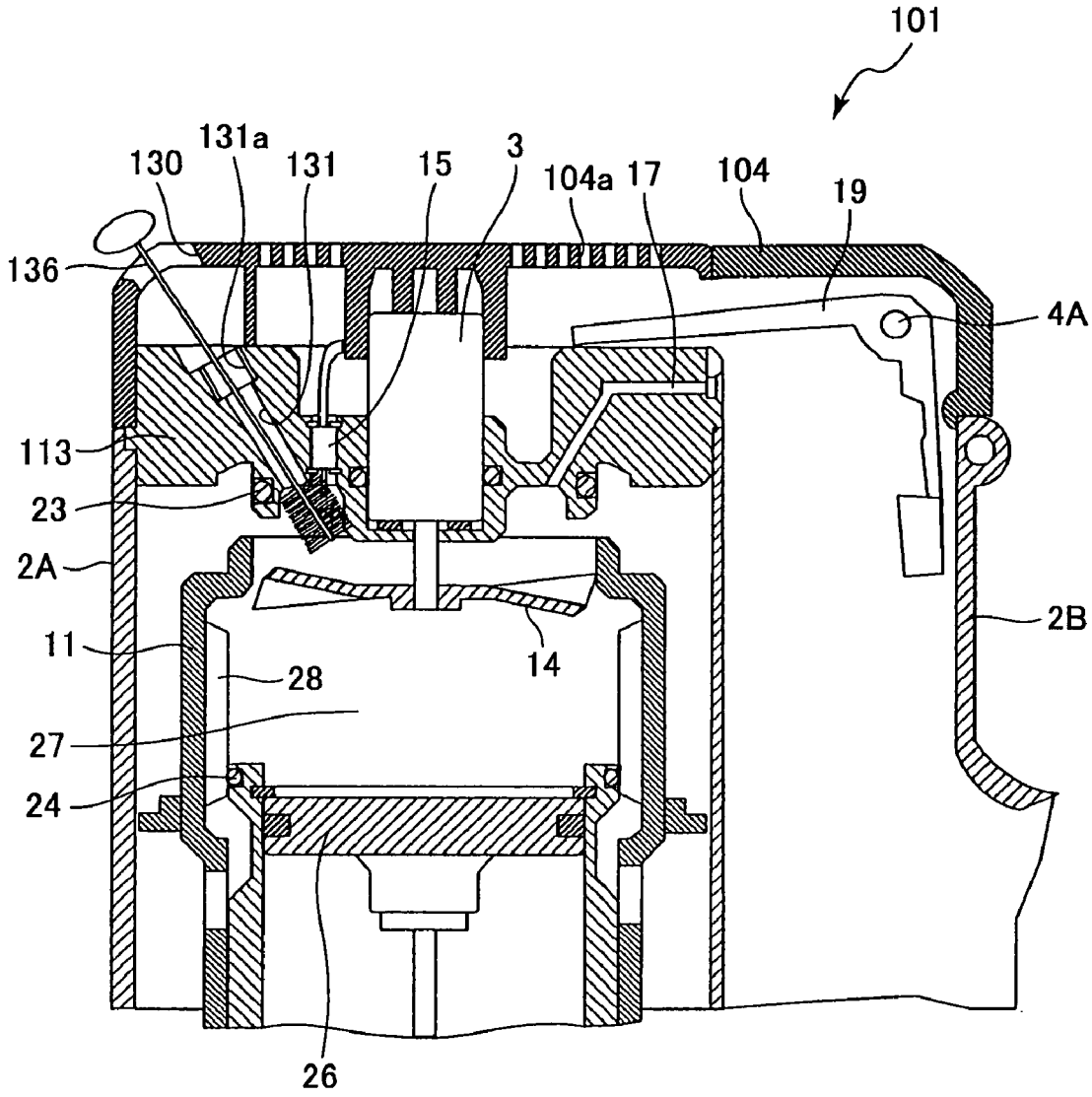
FIG. 4 is a partial cross-sectional view showing the combustion type nail driving tool according to the second embodiment of the present invention and showing a cleaning state.

FIG. 3 shows nail driving state of the tool 101. Since the plug member 133 plugs the cleaning passage 131, air communication between the atmosphere and the combustion chamber 27 through the cleaning passage 131 is blocked. FIG. 4 shows a cleaning state. After the gas canister 5 and the plug member 131 are removed, a cleaning brush 136 is inserted thorough the cleaning passage 131, and a cleaning liquid is introduced into the cleaning passage 131 for cleaning the base electrode 15A and the opposing electrode 15B of the ignition plug 15 with the cleaning brush 136 and the cleaning liquid. In the combustion type nail driving tool according to the second embodiment, cleaning passage can be easily opened and closed by the detachment and attachment of the plug member.

Figure 6:
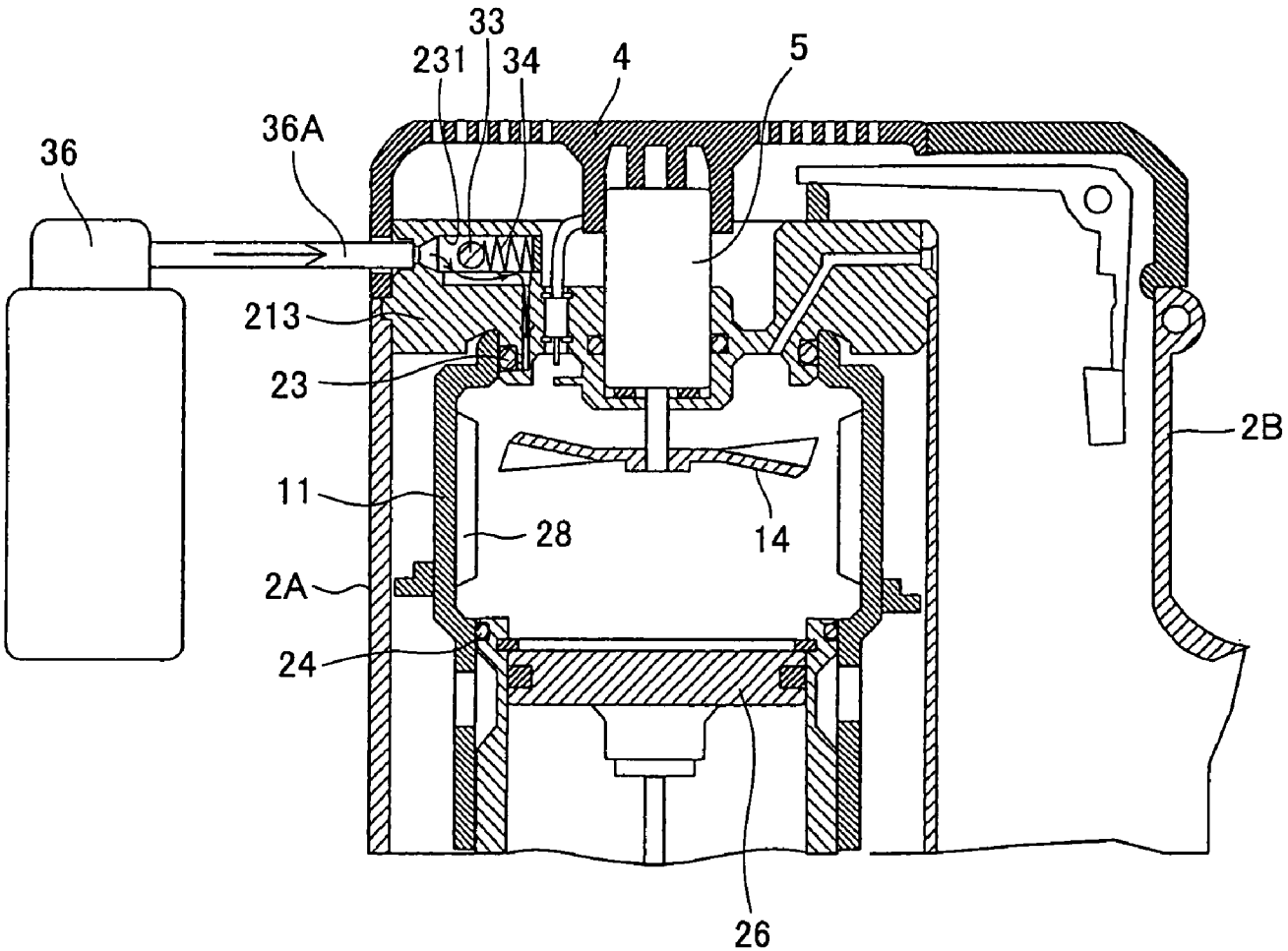
FIG. 6 is a partial cross-sectional view showing the combustion type-nail driving tool according to the third embodiment of the present invention and showing a cleaning state.
Figure 7:
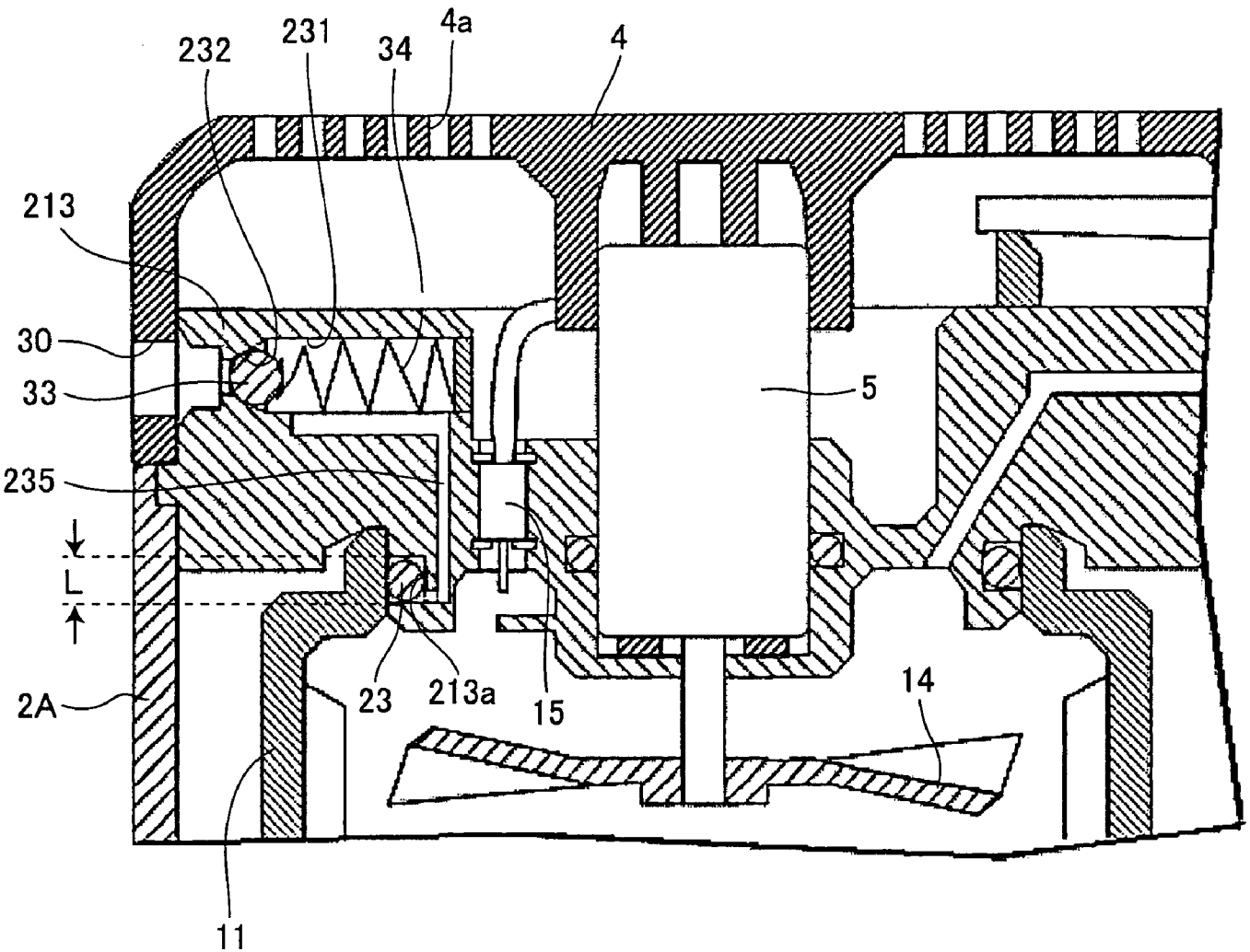
FIG. 7 is a partial cross-sectional view showing an essential portion of the combustion type nail driving tool according to the third embodiment of the present invention and showing the cleaning state.

A combustion type nail driving tool according to a third embodiment of the present invention will be described with reference to FIGS. 5 through 7. In the first and second embodiments, cleaning target is the spark generating electrodes 15A and 15B, whereas in the third embodiment first and second sealing members 23, 24 and their ring grooves are cleaning targets.

Similar to the first embodiment, in a head cap 213 a first cleaning passage 231 extends in a radial direction. The cleaning passage 231 has one end open to the insertion hole 30 of the head cover 4. Further, the cleaning passage 231 is formed with a reduced diameter portion serving as a valve seat 232 at a position near the one end of the cleaning passage 231. A spherical check valve 33 can be seated on the valve seat 232. The first cleaning passage 231 has an inner end closed. A compression coil spring 34 is interposed between the inner end and the check valve 33 for normally biasing the check valve 33 in a direction to seat on the valve seat 232.

The head calve 213 is formed with an O-ring groove 213*a* for accommodating therein a first sealing member 23. The O-ring groove 213*a* has a rectangular cross-section, and has a length L in an axial direction of the cylinder 20 slightly greater than a diameter of the first sealing member 23. Within the head cap 213, a second cleaning passage 235 is formed. The second cleaning passage 235 has one end branched from the first cleaning passage 231 and another end in communication with an inside of the O-ring groove 213*a*. That is, the other end of the second cleaning passage 235 is fluidly connected to a bottom wall of the O-ring groove 213*a* in alignment with a lower groove wall of the O-ring 213*a*. The check valve 33 and the compression coil spring 34 permit fluid to pass from the insertion hole 30 into the second cleaning passage 235, and prevent the fluid from flowing from the second cleaning passage 235 to the insertion hole 30. Further, the compression coil spring 34 has a sufficient spring force for seating the check valve 33 onto the valve seat 32 even in the thermal vacuum phase of the combustion chamber 27.

Figure 5:
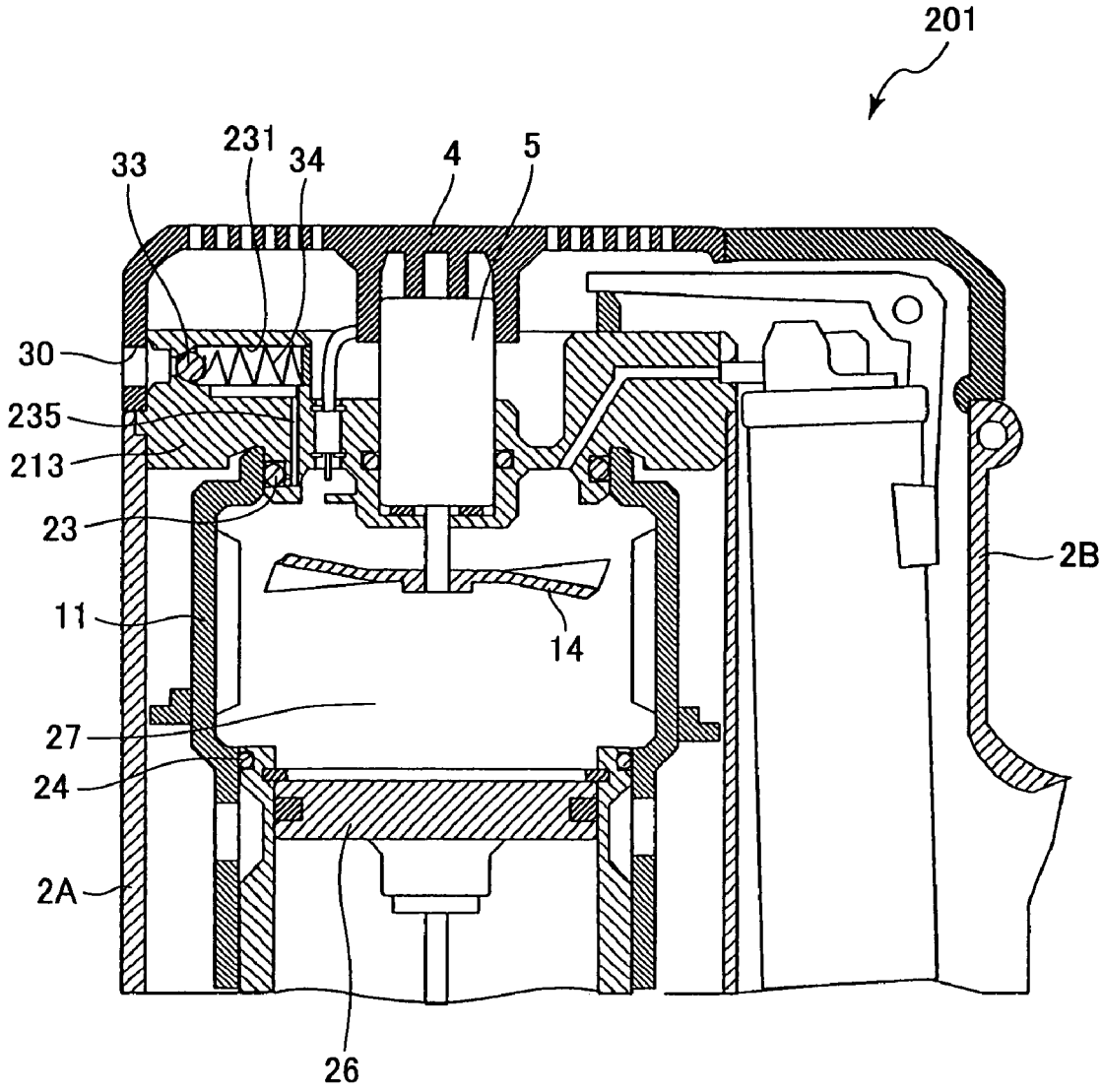
FIG. 5 is a partial cross-sectional view showing a combustion type nail driving tool according to a third embodiment of the present invention and showing a fastener driving state.

As shown in FIG. 5, in the operational state of the tool 201, the check valve 33 is seated on the valve seat 32 so that the communication between the combustion chamber 27 and the atmosphere through the cleaning passages 231, 235 is blocked. FIGS. 6 and 7 show cleaning state. After the gas canister 5 is removed, the combustion chamber frame 11 is elevated through the push lever 10 (FIG. 1) so as to maintain sealing state of the first and second sealing members 23, 24 relative to the inner peripheral surface of the combustion chamber frame 11. Then, the nozzle 36A of the compression type cleaning liquid canister 36 is inserted into the insertion hole 30, and the compressed cleaning liquid is injected. As a result, the check valve 33 is moved away form the valve seat 232 against the biasing force of the compression coil spring 34 by the injection pressure of the cleaning liquid. Thus, the cleaning liquid is injected into the O-ring groove 213*a* through the first and second cleaning passages 231,235 along the bottom wall and lower side wall of the O-ring groove 213*a*. The cleaning liquid is filled at a gap defined between the annular first sealing member 23 and the O-ring groove 213*a*. Consequently, the first sealing member 23 and the O-ring groove 213*a* can be cleaned.

The cleaning liquid is then flowed from the lower side of the first sealing member 23 and supplied to the inner peripheral surface of the combustion chamber frame 11 in contact with the outer peripheral surface of the first sealing member 23. Further, the cleaning liquid runs downwardly along the inner peripheral surface of the combustion chamber frame 11 and reaches the second sealing member 24. By repeating upward and downward motion of the combustion chamber frame 11 and repeated injection of the cleaning liquid, a dirt or unwanted deposition at the first and second sealing members 23, 24 and their associated ring grooves can be washed out and flowed out of the main housing 2A together with the cleaning liquid, thereby cleaning the sealing portions. In this way, in the combustion type nail driving tool 201 according to the third embodiment, sealing portions including the first and second sealing members 23, 24 can be easily cleaned by supplying cleaning liquid into the cleaning passage.

While the invention has been described in detail and with reference to specific embodiments thereof, it would be apparent to those skilled in the art that various changes and modification may be made therein without departing from the scope of the invention defined in claims. For example, in the above-described embodiment, the opposing electrode is positioned at a body of the ignition plug, whereas the base electrode positioned spaced away from the opposing electrode is integral with the head cover. However, the base electrode and the opposing electrode can be provided to the body of the ignition plug. Further, in the second embodiment, a cotton tipped swab can be used instead of the cleaning brush 136. Moreover, the dirt can be blown away by a high pressure air blower after application of the cleaning liquid.

What is claimed is:

1. A combustion-type power tool comprising:

a housing having one end and a lower side;

a head section closing the one end of the housing and formed with a combustible gas passage;

a push lever provided to the lower side of the housing and movable upon pushing onto a workpiece;

a cylinder secured to an inside of the housing;

a piston slidably disposed in the cylinder and reciprocally movable in an axial direction of the cylinder, the piston dividing an interior of the cylinder into a lower cylinder chamber below the piston and an upper cylinder chamber above the piston;

a combustion chamber frame movably provided in the housing, the combustion chamber frame being abuttable on and separable from the head section in interlocking relation to the movement of the push lever, a combination of the head section, the upper cylinder chamber, and the combustion chamber frame defining a combustion chamber;

a first sealing section providing a sealing relation between the combustion chamber frame and the head section when the combustion chamber frame is brought into abutment with the head section;

an ignition plug supported to the head section and having a spark generating portion exposed to the combustion chamber for igniting a mixture of air and the combustible gas in the combustion chamber, at least one of the spark generating portion and the first sealing section being a target to be cleaned during non-operational state of the power tool;

the head section being formed with a cleaning passage having one end open to an atmosphere and another end open to the target to be cleaned; and a shut-off unit provided in the cleaning passage for shutting-off the cleaning passage from the atmosphere during fastener driving operation.

2. The combustion-type power tool as claimed in claim 1, wherein the shut-off unit comprises:

a one-way valve disposed within the cleaning passage; and a biasing member urging the one-way valve in a direction to close the cleaning passage.

3. The combustion-type power tool as claimed in claim 2, wherein the cleaning passage includes a first cleaning passage extending in a radial direction of the head section and having one end open to the atmosphere and another sealed end, and a second cleaning passage having one end in communication with and branched from the first cleaning passage and another end open to the target to be cleaned, the one-way valve and the biasing member being disposed in the first cleaning passage.

4. The combustion-type power tool as claimed in claim 3, wherein the target to be cleaned is the spark generating portion.

5. The combustion-type power tool as claimed in claim 1, wherein the first sealing section comprises a seal ring, the head section being formed with an annular groove for assembling therein the seal ring, the cleaning passage being in fluid communication with a bottom surface of the annular groove.

6. The combustion-type power tool as claimed in claim 5, wherein the cleaning passage includes a first cleaning passage extending in a radial direction of the head section and having one end open to the atmosphere and another sealed end, and a second cleaning passage having one end in communication with and branched from the first cleaning passage and another end open to the bottom surface of the annular groove, the one-way valve and the biasing member being disposed in the first cleaning passage.

7. The combustion type power tool as claimed in claim 5, further comprising a second sealing section providing a sealing relation between the combustion chamber frame and the cylinder when the combustion chamber frame is brought into abutment with the head section, a portion of the second sealing section being a target to be cleaned.

8. The combustion type power tool as claimed in claim 1, further comprising a second sealing section providing a sealing relation between the combustion chamber frame and the cylinder when the combustion chamber frame is brought into abutment with the head section, the second sealing section being a target to be cleaned.

9. The combustion-type power tool as claimed in claim 1, wherein the cleaning passage has an inner peripheral surface formed with a female thread; and wherein the shut-off unit comprises a plug member having an outer peripheral surface formed with a male thread detachably and threadingly engageable with the female thread.

10. The combustion type power tool as claimed in claim 1, wherein the cylinder is formed with an exhaust hole; and the combustion type power tool further comprising:

a handle extending from the housing and provided with a trigger switch;

a motor provided at the head section;

a driver blade extending from the piston toward a side opposite to the combustion chamber and movable together with the piston;

a fan rotatably positioned in the combustion chamber and drivingly rotated upon rotation of the motor;

an exhaust check valve selectively opening the exhaust hole;

a magazine positioned below the housing for accommodating fasteners; and a tail cover for feeding the fasteners accommodated in the magazine to a position below the driver blade, and allowing a tip end of the driver blade to be inserted thereinto.

11. A combustion-type power tool comprising:

a housing;

a handle extending from the housing and provided with a trigger switch;

a head section closing one end of the housing and formed with a combustible gas passage;

a motor provided at the head section;

a push lever provided to a lower side of the housing and movable upon pushing onto a workpiece;

a cylinder secured to an inside of the housing and formed with an exhaust hole;

a piston slidably disposed in the cylinder and reciprocally movable in an axial direction of the cylinder, the piston dividing an interior of the cylinder into a lower cylinder chamber below the piston and an upper cylinder chamber above the piston;

a combustion chamber frame movably provided in the housing, the combustion chamber frame being abuttable on and separable from the head section in interlocking relation to the movement of the push lever, a combination of the head section and the upper cylinder chamber, and the combustion chamber frame defining a combustion chamber;

a driver blade extending from the piston toward a side opposite to the combustion chamber and movable together with the piston;

a first sealing section providing a sealing relation between the combustion chamber frame and the head section when the combustion chamber frame is brought into abutment with the head section, and a second sealing section providing a sealing relation between the combustion chamber frame and the cylinder when the combustion chamber frame is brought into abutment with the head section;

a fan rotatably positioned in the combustion chamber and drivingly rotated upon rotation of the motor;

an ignition plug supported to the head section and having a spark generating portion exposed to the combustion chamber for igniting a mixture of air and the combustible gas in the combustion chamber;

an exhaust check valve selectively opening the exhaust hole;

a magazine positioned below the housing for accommodating fasteners;

a tail cover for feeding the fasteners accommodated in the magazine to a position below the driver blade, and allowing a tip end of the driver blade to be inserted thereinto, at least one of the spark generating portion, the first sealing section, and the second sealing section being a target to be cleaned during non-operational state of the power tool, the head section being formed with a cleaning passage having one end open to an atmosphere and another end open to the target to be cleaned; and a shut-off unit provided in the cleaning passage for shutting-off the cleaning passage from the atmosphere during fastener driving operation.

12. The combustion-type power tool as claimed in claim 11, wherein the shut-off unit comprises a one-way valve disposed within the cleaning passage and urged in a direction to close the cleaning passage.

13. The combustion-type power tool as claimed in claim 11, wherein the first sealing section comprises a seal ring, the head section being formed with an annular groove for assembling therein the seal ring, the cleaning passage being in fluid communication with a bottom surface of the annular groove.

14. The combustion-type power tool as claimed in claim 11, wherein the cleaning passage has an inner peripheral surface formed with a female thread; and wherein the shut-off unit comprises a plug member having an outer peripheral surface formed with a male thread detachably and threadingly engageable with the female thread.

* * * * *